US007430976B2

(12) United States Patent
Ketterman et al.

(10) Patent No.: US 7,430,976 B2
(45) Date of Patent: Oct. 7, 2008

(54) TWIST AND STOW RUDDER

(75) Inventors: Gregory S. Ketterman, Vista, CA (US); James T. Czarnowski, Encinitas, CA (US); Jason Christopher Kardas, Vista, CA (US)

(73) Assignee: Hobie Cat Co., Oceanside, CA (US)

( * ) Notice: Subject to any disclaimer, the term of this patent is extended or adjusted under 35 U.S.C. 154(b) by 0 days.

(21) Appl. No.: 11/881,136

(22) Filed: Jul. 24, 2007

(65) Prior Publication Data

US 2008/0029010 A1 Feb. 7, 2008

Related U.S. Application Data

(60) Provisional application No. 60/835,271, filed on Aug. 2, 2006.

(51) Int. Cl.
*B63H 25/06* (2006.01)

(52) U.S. Cl. ..... 114/165; 114/162

(58) Field of Classification Search ..... 114/162, 114/163, 164, 165, 168, 169, 172
See application file for complete search history.

(56) References Cited

U.S. PATENT DOCUMENTS

| | | | | |
|---|---|---|---|---|
| 4,211,180 | A * | 7/1980 | Brooks, Jr. | 114/162 |
| 4,372,241 | A * | 2/1983 | Tritt | 114/162 |
| 4,556,006 | A | 12/1985 | Kaupat | |
| 5,447,113 | A * | 9/1995 | Chernin | 114/162 |
| 5,713,295 | A | 2/1998 | Bridge et al. | |
| 6,684,804 | B2 | 2/2004 | Gustafsson et al. | |
| 6,739,276 | B1 | 5/2004 | Rard | |
| 2005/0039664 | A1 * | 2/2005 | Arnold | 114/162 |

* cited by examiner

*Primary Examiner*—Lars A Olson
(74) *Attorney, Agent, or Firm*—Joseph E. Mueth, Esq.

(57) ABSTRACT

A retraction system for rudders for small boats having a deck comprising a rudder means connecting said rudder to the rear of a boat enabling said rudder to pivot on an axis such that when the rudder is retracted, it rotates upwardly through about 270° from the normal operating position in the water while twisting about 90° so as to lay essentially flat on said deck.

6 Claims, 7 Drawing Sheets

TWIST AND STOW RUDDER

This application claims the benefit of U.S. Provisional Patent Application Ser. No. 60/835,271, filed Aug. 2, 2006.

FIELD OF INVENTION

This invention relates to retraction systems for rudders for small boats.

BACKGROUND OF INVENTION

Beachable boats have used retractable rudders for many years and there have been many variations of methods to retract the rudder.

Rudder assemblies commonly have the ability to;

1) Securely hold the rudder in a vertical or down position for use while the vessel is underway.
2) Securely hold the rudder in a retracted or up position for times when it is desirable to have the rudder in the retracted position.
3) Break free of the vertical or down position when the rudder strikes a submerged object of the lake/ocean bottom without causing damage to the rudder assembly.
4) Raise or lower the rudder to the desired positions using one of a combination of a variety of devices including ropes, levers, cams, and springs.

One problem with the existing rudder assemblies is that the rudder is still standing proud and is vulnerable to damage when it is retracted.

1) U.S. Pat. No. 6,739,276 describes a mechanism for retracting the rudder, but the rudder is always vulnerable in all of the positions.
2) U.S. Pat. No. 6,684,804 describes a design that is not vulnerable because it is flexible, but it does not have good authority to turn the boat and the rudder adds dimension to the boat.
3) U.S. Pat. No. 5,713,295 describes a rudder that is not vulnerable, but it would not have good authority to turn the boat.
4) U.S. Pat. No. 4,556,006 describes a retracting system but the rudder is vulnerable in all positions.

SUMMARY OF THE INVENTION

A retraction system for rudders for small boats having hull, cockpit and a deck comprising a rudder means connecting said rudder to the rear of a boat enabling said rudder to pivot on an axis such that when the rudder is retracted, it rotates upwardly through about 270° from the normal operating position in the water while twisting about 90° so as to lay flat on said deck.

In the present invention in which the rudder retraction system allows the rudder to lay flat on the deck of the stern when the rudder is retracted, the rudder pivots on an axis that is at an angle such that when the rudder is retracted it rotates through about 270° from the normal operating position and twists about 90°.

The angle of the axis that the rudder head rotates about is a compound angle. First, while looking down on the rudder, the rudder head rotates counter clockwise about 45° and then in the orthogonal and vertical plane rotates aft about 55°.

The rudder has one control line to rotate the rudder down and one to rotate the rudder up. Tension in the down control line holds the rudder in the down position. When the rudder is in the down position and the rudder hits an object or the beach there is enough stretch or give in the down control line that the rudder can swing back and out of the way. A bungi cord may be used in series with the down control line to increase stretch. After the encounter the rudder will swing back into the down position.

The up/down control lines lead forward to a lever on the right side of the boat just behind the cockpit. A 180° rotation of the lever will move the rudder from full retracted position to the full down or operation position and visa versa.

When the rudder begins to swing up the motion of the rudder is back and to the side. Tension in the down control line is enough to prevent the rudder from swinging back, but the rudder can generate large force to the side and these side forces must be transmitted to the hull as these are the forces required to turn the boat. The rudder must not be allowed to rotate up as a result of side loads and tension in the down control line is not enough to prevent the rudder from rotating up as a result of side loads.

The rudder mount has a hook that engages a detent in the rudder head when a side force is applied to the rudder. This hook withstands the pressure and prevents the rudder from rotating up under side loading.

In the preferred embodiment, the rudder head has 6 holes to receive 6 screws for attaching the rudder blade. A normal or large rudder blade can be attached.

The rudder mount has two bearings to allow the rudder mount to pivot about a vertical axis. This rotation rotates the rudder to steer the boat. Both up/down control lines enter the rudder mount through a small hole near this vertical axis or point of rotation so that tension in these control lines does not change as the rudder turns from right to left. After the control lines enter the rudder mount they split and go in opposite direction around a quadrant which is part of the rudder head. The up control line goes up and around the quadrant so that tension in this line will cause the rudder head to rotate up. The down control line goes down and around the quadrant so that tension in this line will cause the rudder head to rotate down.

There are two more control lines for turning the rudder to the left or right. These control lines lead forward to a lever on the left side of the boat near the cockpit. A 70 degree rotation of this lever will rotate the rudder from full left turn to full right turn. The rudder turns approximately +/−45° from straight ahead.

OBJECTS AND ADVANTAGES

The main objective of the design is to make rudder as compact and invulnerable as possible when it is in the retracted position. Since the rudder is generally flat and the deck of the back of the boat is flat, it makes sense to stow the rudder flat on the back of the deck. When the rudder is retracted it adds very little dimension to the boat. This feature was very desirable because the rudder can be installed at the factory and the boat can be shipped with the rudder installed.

A further benefit is that the rudder provides a very low profile or no windage when it is retracted. If the rudder is exposed to the wind it may tend to turn the boat into the wind which is not desirable.

The rudder retraction system allows the rudder to be positioned on the deck when not in use and yet is readily deployed when the boat is put to use. The rudder in use in the normal operating position is effective in steering the boat. At the same time, should the rudder strike a submerged object, the rudder gives way and thereby avoids being damaged.

THE DRAWINGS

FIG. 6 shows the following:

1. A partial side view of the hull, rudder, rudder head, rudder mount.
2. A section taken along the line E-E in 1 to show the engagement of the hook on the rudder mount and detent on the rudder head.
3. A section taken at F in 2 showing an enlargement of the hook and detent as engaged.
4. A side view of a small boat with the retraction system at A, the rudder being directly down in the water.

Figure 6:
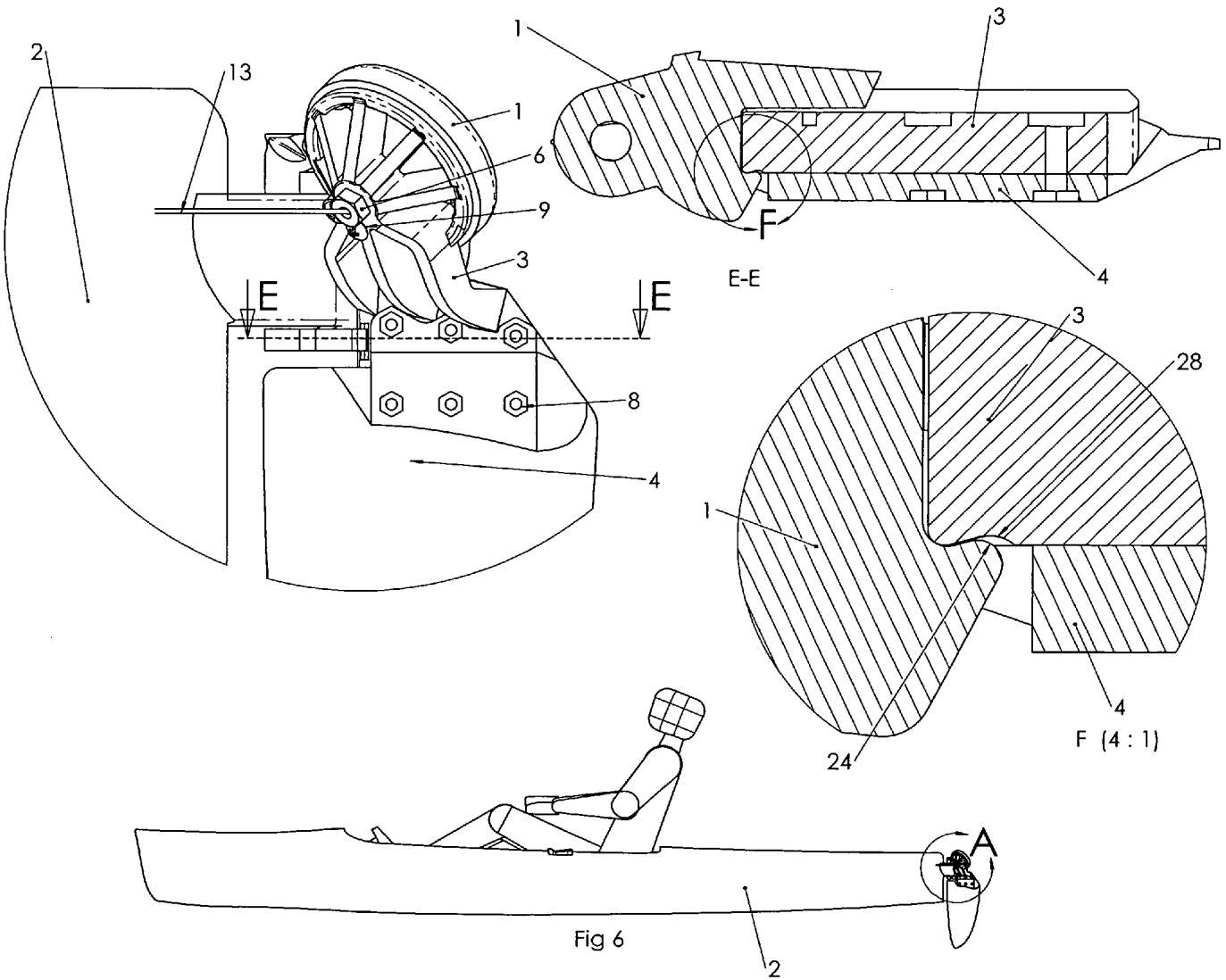
FIG. 6 shows the hook engaging the detent to keep the rudder from rotating up under side loads and FIG. 6A shows these parts shortly after disengagement. More particularly.
Figure 6A:
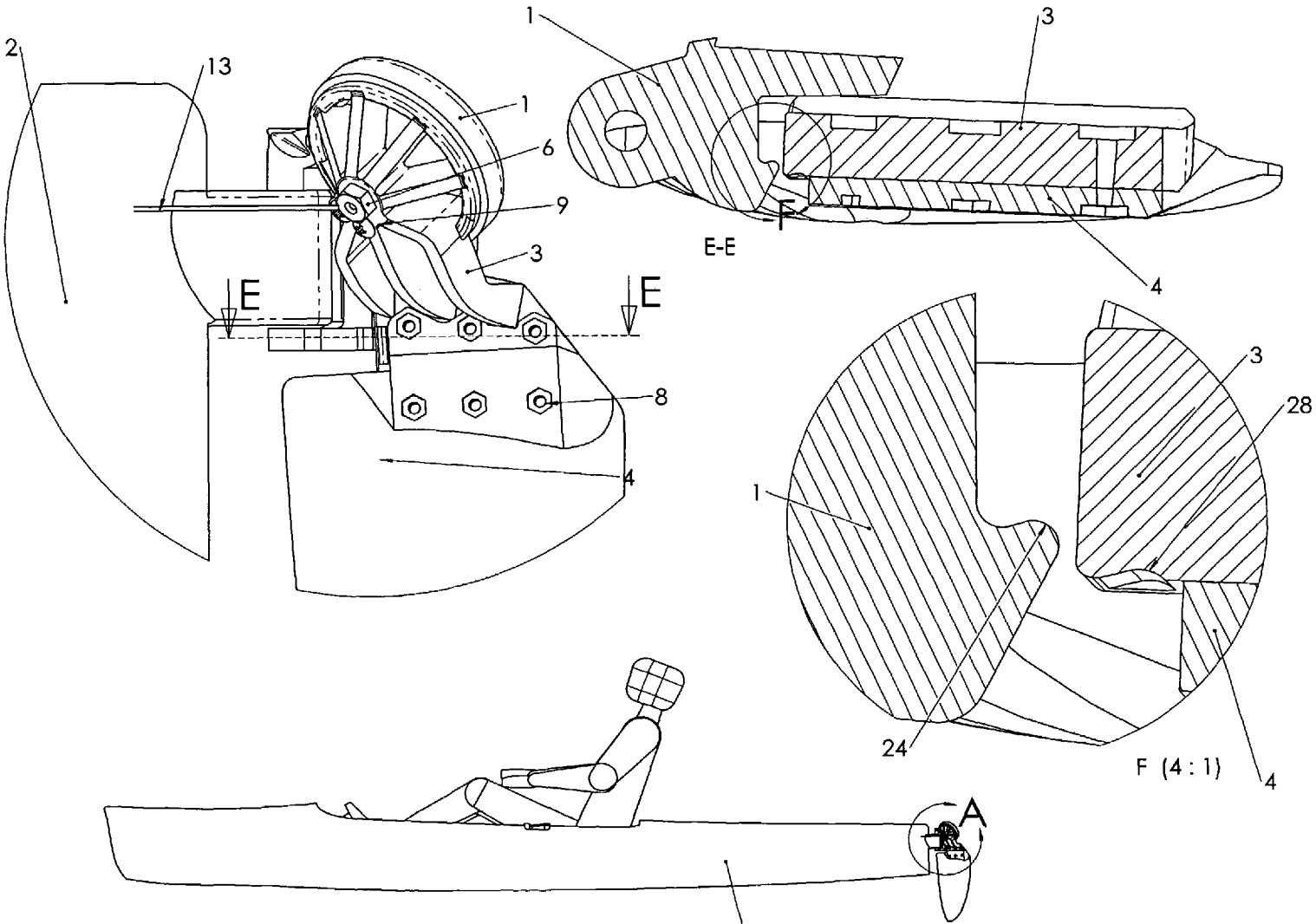

FIG. 6A depicts the same parts and views as FIG. 6, showing, however, the hook and detent shortly after disengagement and the beginning of the rotation of the rudder so that the leading edge of the rudder is starting to move away from the hull.

Figure 7:
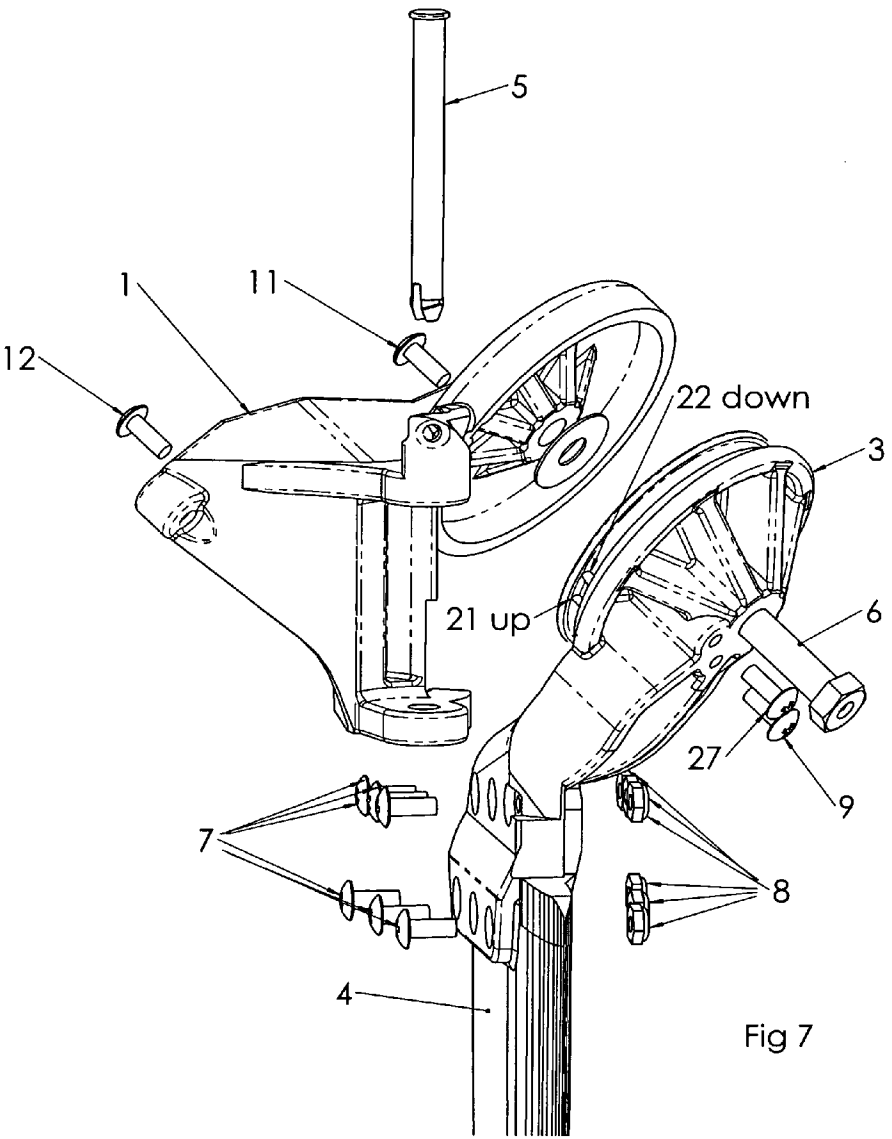

FIG. 7 shows the exploded view of the parts in the rudder assembly.

DESCRIPTION OF THE PREFERRED EMBODIMENT

Considering the drawings in more detail, the rudder mount 1 is pinned to the hull 2 with pin 5. The rudder head 3 is pivotally bolted to the rudder mount 1 with bolt 6. The rudder blade 4 is fastened to the rudder head 3 with six 10-32 screws 7 and six 10-32 lock nuts 8.

The rudder mount 1 is free to pivot on the transom 25 of the hull 2. The left steering line 13 exits the hull 2 and passes through a hole through the center of bolt 6. The left steering line 13 is then clamped under the 10-32 screw 11. The right steering line 14 exits the hull 2 at small hole 26 and passes through a hole in the rudder mount 1 and is clamped under the 10-32 screw 12.

The forward end of the left steering line 13 attaches to the right hand end of the steering control lever 17. The forward end of the right steering line 14 attaches to the left hand end of the steering control lever 17. Turning the steering handle 18 adjacent cockpit 29 to the right will rotate the rudder to the left which will turn the boat to the right.

The trim of the rudder and the tension in the steering lines 13 and 14 can be adjusted with these screws 11 and 12. The lines 13 and 14 should be adjusted so that the rudder blade 4 is pointed straight ahead when the steering handle 18 is in the middle of its travel. The tension in the lines 13 and 14 should be adjusted so they are tight enough so that there is no play, but not so tight that there is excessive friction in the system.

The up control line 15 exits the transom of hull 2 and passes through two small holes in the rudder mount 1. After the second hole it goes up and around the quadrant 30 on the rudder head 3. The line passes through a small hole 21 in the rudder head 3 and then it is clamped under the 10-32 screw 9. The down control line 16 exits the transom of hull 2 and passes through the same two holes in the rudder mount 1. After the second hole it goes down and around the quadrant 30 on the rudder head 3. The line goes through the small hole 22 on the rudder head 3 and it is clamped under 10-32 screw 22.

The forward end of the down control line 16 goes forward and around the cheek block 23 and back to the up/down control lever 19 so that when the up/down control lever 19 adjacent cockpit 29 is moved forward the rudder goes down. The up control line 15 goes forward directly to the up/down control lever 19.

Figure 1:
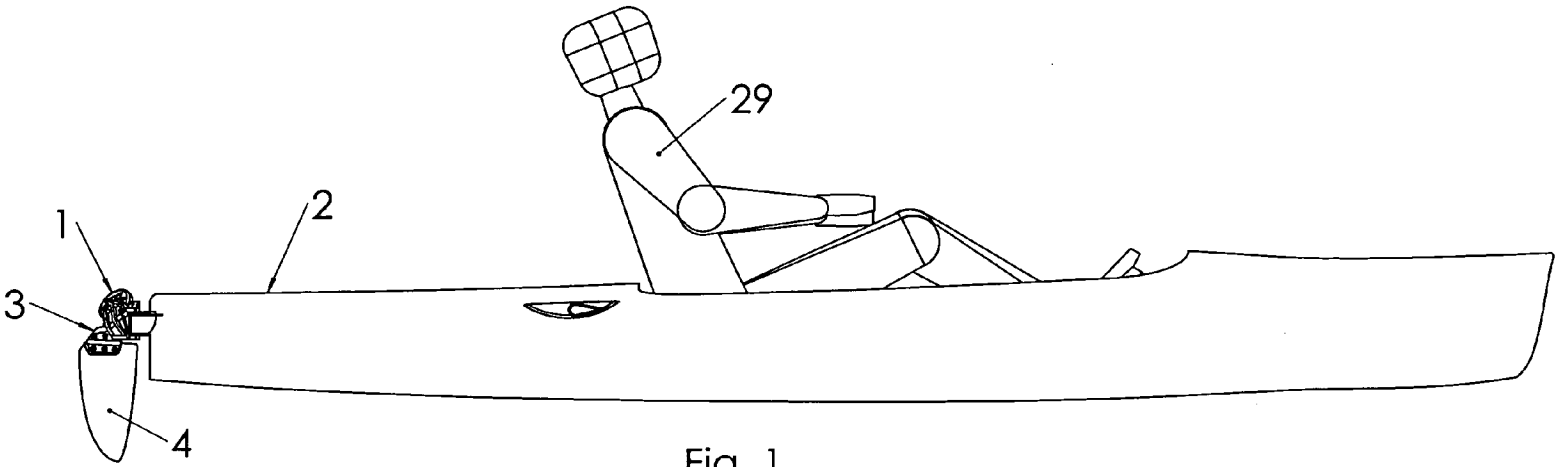
FIG. 1 is a side view of the rudder assembly in the down position with the rudder in the water on a typical kayak.
Figure 2:
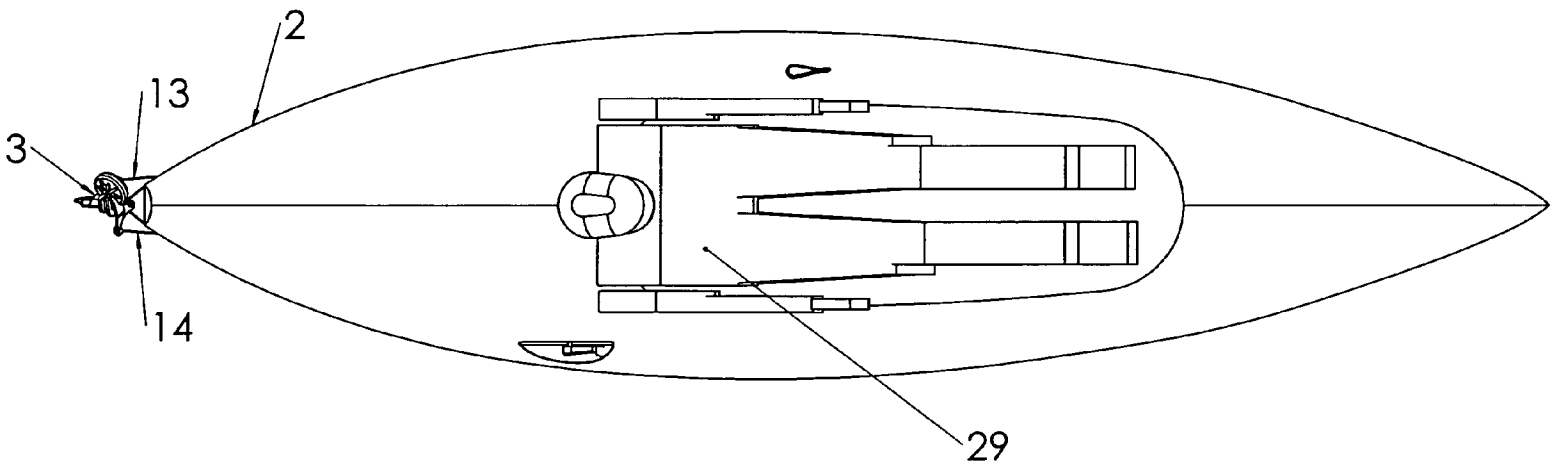
FIG. 2 is a top view of the rudder assembly in the down position on a typical kayak.
Figure 3:
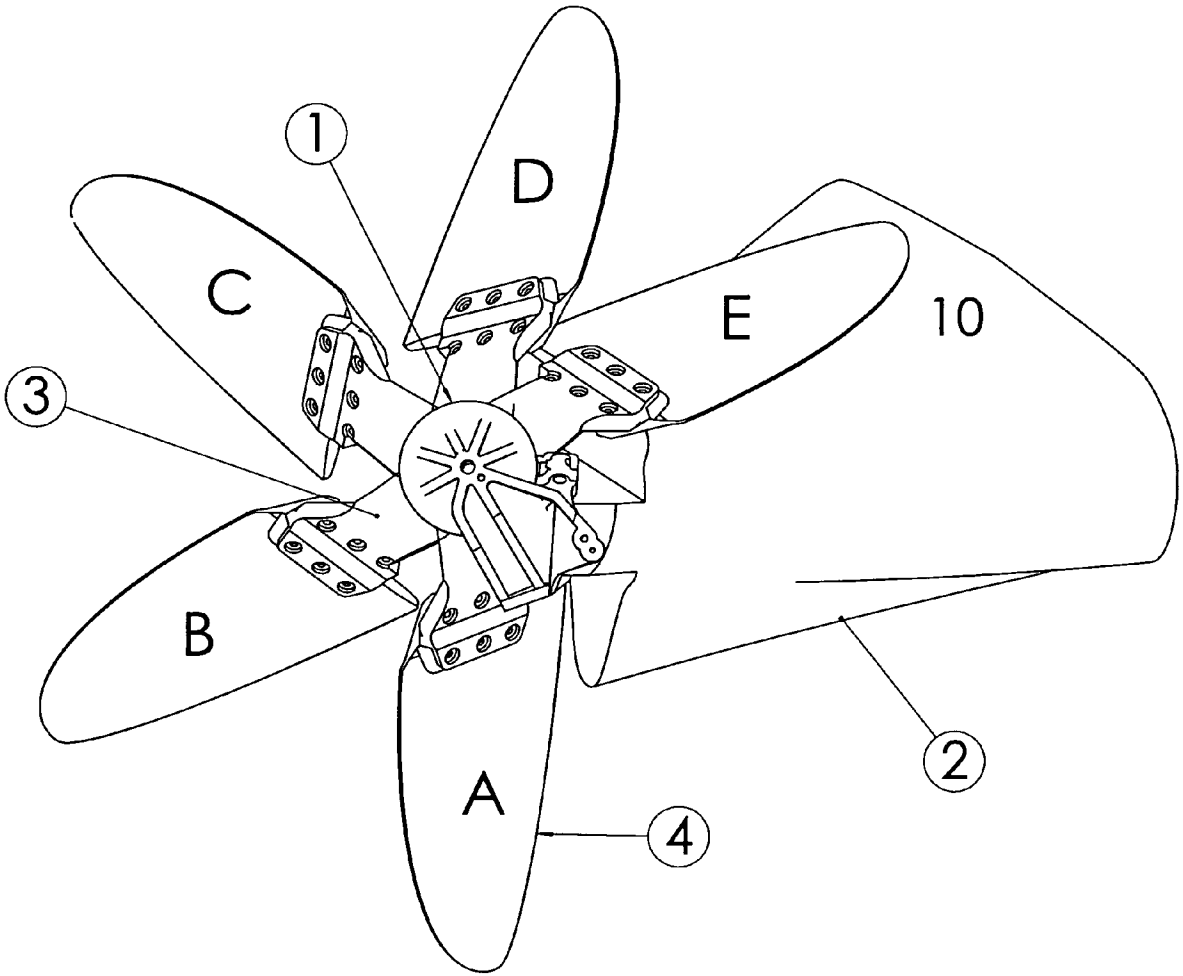
FIG. 3 is an isometric view of the rudder assembly going through the full motion from down position or operation position to the up or retracted position.
Figure 4:
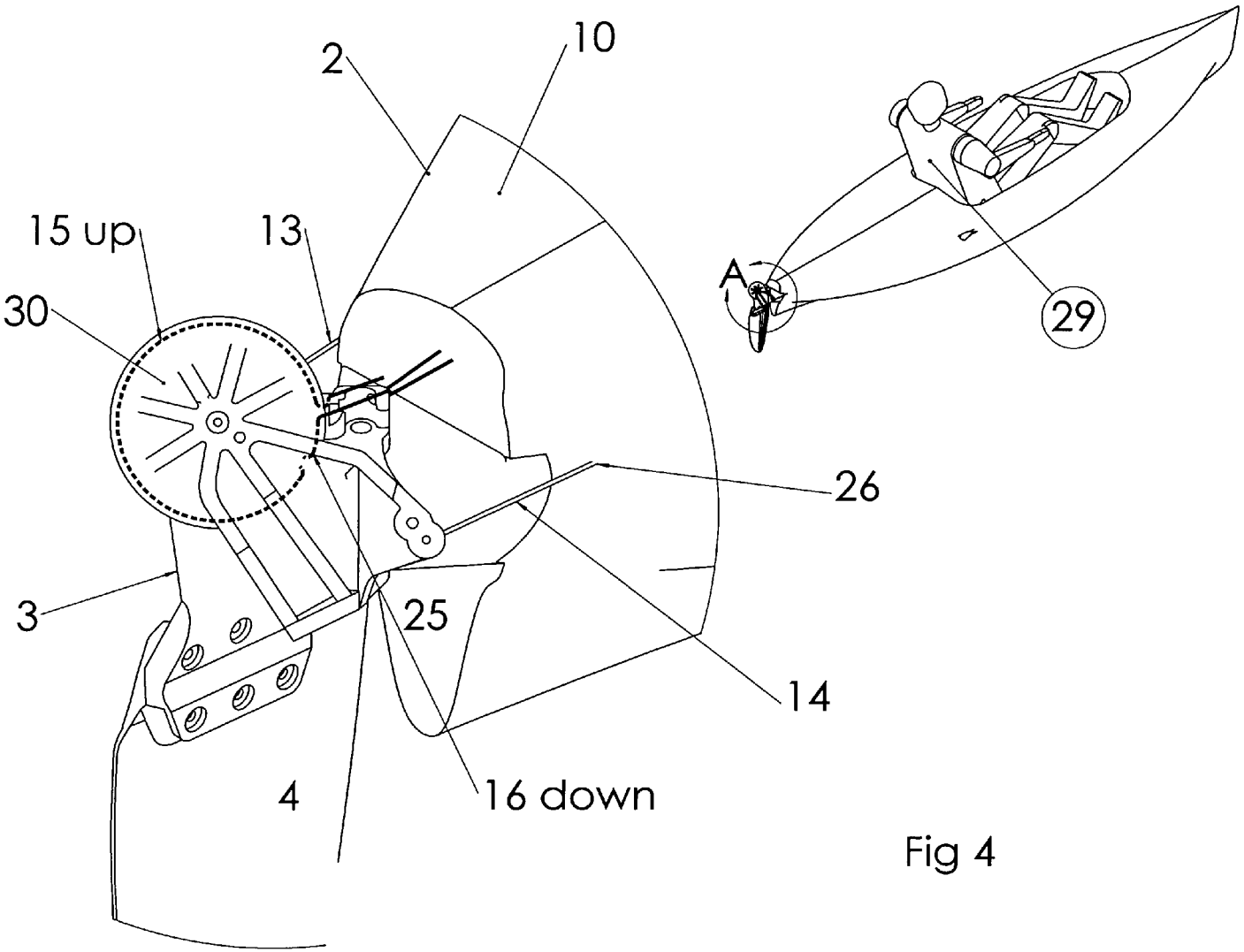
FIG. 4 shows the up and down control lines wrapping around the quadrant.
Figure 5:
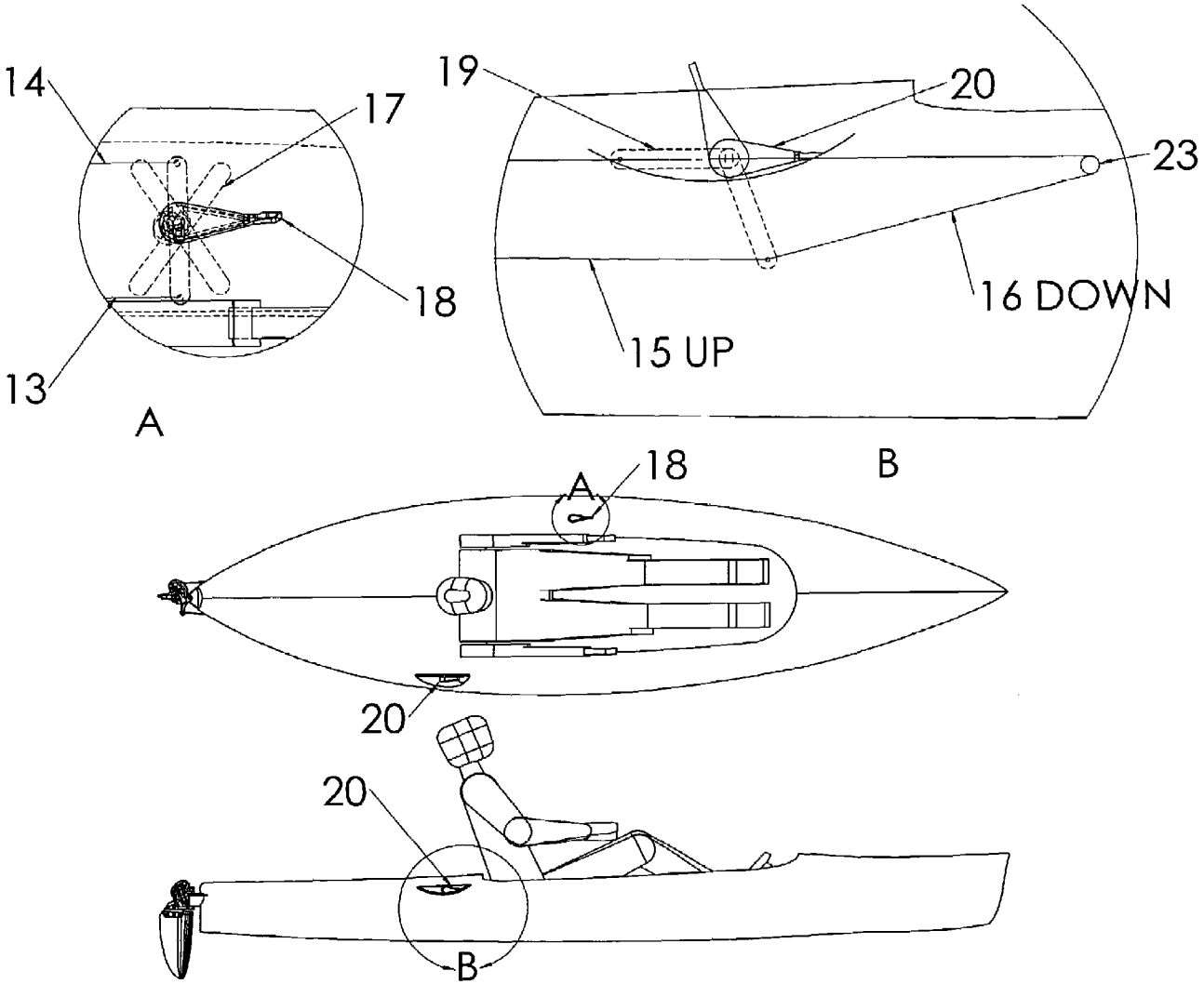
FIG. 5 shows the steering lines going to the steering handle lever and the up/down lines going to the up/down control lever.

FIG. 3 shows the rudder blade 4 as it rotates upwardly starting at the normal down or vertical position in the water at the rear of hull 2. As shown in FIG. 3, as the rudder blade 4 moves upwardly through 270°, from positions A through E, simultaneously the rudder blade 4 rotates through 90° so that the rudder blade 4 lays flat on the deck or top surface 10 of hull 2.

The tension in the up/down control lines 15 and 16 can be adjusted with the screws 9 and 10. The tension in the down control line 16 should be adjusted so that when the rudder is in the down position and up/down control handle 20 adjacent cockpit 29 is in the forward position there should be about 5 pounds of tension in the line. In this position the up control line should have about a ¼" of slack in it. When the up/down control handle is rotated 180° to the back position the rudder will rotate through 270° and lay flat on the deck 10 in the retracted position.

Tension in the down control line 16 is sufficient to keep the rudder down ordinarily. If the rudder blade 4 generates a significant lateral load while making a right turn or while sailing on a starboard tack the tension in the down control line is not sufficient to keep the rudder down. This lateral load will cause the rudder head 3 to move to the left and the hook 24 will engage the detent 23. In order for the rudder head 3 to move to the left there needs to be some freedom of movement between the rudder mount 1 and the rudder head 3. If the rudder head 3 rotates straight back as if the rudder hit a submerged object or if the up control line 15 is pulled, the hook 24 will not engage the detent 28.

Freedom of movement between the rudder mount 1 and the rudder head 3 is provided by about 0.022" clearance between the bolt 6 and the mating hole in the rudder head 3. The bolt is tightly threaded into the rudder mount 1. The bolt cannot be too tight.

The invention claimed is:

1. A retraction system for rudders for small boats having a hull with cockpit and deck comprising a rudder means connecting said rudder to the rear of a boat enabling said rudder to pivot on an axis such that when the rudder is retracted, it rotates upwardly through about 270° from a normal operating position in the water while twisting about 90° so as to lay essentially flat on said deck.

2. The retraction system of claim 1 wherein said means connecting said rudder includes a rudder mount pivotally attached to the transom of said hull.

3. The retraction system of claim 2 wherein a rudder head is pivotally attached to said rudder mount and the rudder head rotates about an axis at a compound angle defined by looking down at the rudder in the normal operating position, the rudder head rotates counterclockwise about 45° and then in the orthogonal and vertical plane rotates aft about 55°.

4. The retraction system of claim 1 having one control line to rotate the rudder up and one to rotate the rudder down, said lines being operably connected to control means adjacent said cockpit.

5. The retraction system of claim 1 having two control lines for turning the rudder while in the normal operating position to the left or right about a vertical axis, said lines being operably connected to control means adjacent said cockpit.

6. The retraction system of claim 1 wherein said rudder further has a rudder mount fixed to said hull and said rudder has affixed thereto a rudder head, said rudder mount having a hook and said rudder head having a detent whereby when said hook engages said detent, the rudder is prevented from upward movement under side loading.

* * * * *

UNITED STATES PATENT AND TRADEMARK OFFICE

CERTIFICATE OF CORRECTION

PATENT NO. : 7,430,976 B2 
APPLICATION NO. : 11/881136
DATED : October 7, 2008
INVENTOR(S) : Gregory S. Ketterman, James T. Czarnowski and Jason Christopher Kardas It is certified that error appears in the above-identified patent and that said Letters Patent is hereby corrected as shown below:

Column 4, line 7: screw 22 should read --screw 27--.

Column 4, line 10: should read --so that when the up/down control handle 20--.

Column 4, line 22: should read --screw 9 and 27--.

Signed and Sealed this

Sixteenth Day of December, 2008

JON W. DUDAS
*Director of the United States Patent and Trademark Office*